US007043762B2

(12) United States Patent
Greenhalgh

(10) Patent No.: US 7,043,762 B2
(45) Date of Patent: May 16, 2006

(54) ATHLETIC FINGER, PALM AND WRIST PROTECTIVE PAD

(76) Inventor: Jeffrey Greenhalgh, 14203 Banbury Way, Tampa, FL (US) 33624

( * ) Notice: Subject to any disclaimer, the term of this patent is extended or adjusted under 35 U.S.C. 154(b) by 86 days.

(21) Appl. No.: 10/453,617

(22) Filed: Jun. 4, 2003

(65) Prior Publication Data

US 2004/0244088 A1 Dec. 9, 2004

(51) Int. Cl.
*A41D 13/08* (2006.01)

(52) U.S. Cl. ..... 2/16; 2/20

(58) Field of Classification Search ..... 2/16, 2/20, 17, 159, 160, 161.1, 161.2, 161.4, 161.5, 2/161.6, 163; 602/21, 22
See application file for complete search history.

(56) References Cited

U.S. PATENT DOCUMENTS

| | | | | |
|---|---|---|---|---|
| 1,351,378 A | | 8/1920 | Frankel | |
| 4,287,609 A | | 9/1981 | Amadeo | |
| 4,720,279 A | * | 1/1988 | Fritschen et al. | 441/69 |
| 5,205,812 A | * | 4/1993 | Wasserman | 602/5 |
| 5,298,001 A | * | 3/1994 | Goodson | 482/23 |
| 5,353,440 A | * | 10/1994 | Meldeau | 2/161.1 |
| 5,404,591 A | | 4/1995 | Brinnand et al. | |
| 5,813,950 A | * | 9/1998 | Parker | 482/93 |
| 5,898,944 A | * | 5/1999 | Vrany | 2/161.4 |
| 6,013,044 A | * | 1/2000 | Estwanik | 602/64 |
| 6,024,714 A | | 2/2000 | Katzin | |
| 6,093,165 A | * | 7/2000 | Estwanik | 602/64 |
| 6,226,795 B1 | * | 5/2001 | Winningham | 2/20 |
| 6,374,408 B1 | | 4/2002 | Tomlinson et al. | |
| 6,666,795 B1 | * | 12/2003 | Mah | 482/23 |

* cited by examiner

*Primary Examiner*—Gary L. Welch
(74) *Attorney, Agent, or Firm*—Siemens Patent Services, LC

(57) ABSTRACT

An athletic finger, palm and wrist protective pad comprising a leather pad configured to substantially conform to the shape of a human palm and wrist is disclosed. The leather pad and an added pad proximate the wrist end of the pad provide protection against abrasion of the palm and wrist of a baseball or softball player while sliding into a base or home plate, as well as protection against hyper-extension of the wrist. A foam dowel encased in the leading, finger end of the pad provides a padded gripping surface for the fingers, thereby preventing jamming, as well as protection from debris sliding under the pad. An elastic loop attached to the leading edge of the sleeve slips easily over the fingers of a user and a wrist strap tightens around the wrist, allowing quick and easy donning of the protective pad while on the base path.

15 Claims, 3 Drawing Sheets

ATHLETIC FINGER, PALM AND WRIST PROTECTIVE PAD

BACKGROUND OF THE INVENTION

1. Field of the Invention

The present invention relates to devices for use in protecting an athlete from injury during sports activity. More particularly, the invention comprises an easily donned/removable protective pad to protect the fingers, palm and wrist of a baseball/softball player while sliding into a base.

2. Description of the Prior Art

Among athletes, a primary concern is protection against injury due to collision with one another, objects on or next to the playing field, and the ground. Many items of protective gear have been developed to prevent or minimize injury to various parts of the body during competition. Specific to baseball, such protective items as the batting helmet, catcher's shin and chest pads, batting gloves, and the like, have been developed. Most of these items, however, are bulky and/or require time and effort to don and remove. They are intended to provide protection in specific situations with prior preparation to don them. Highly portable, easily donned protective gear has been relatively non-existent.

U.S. Pat. No. 6,374,408, issued to Davy C. Tomlinson on Apr. 23, 2002, presents a PROTECTIVE ATHLETIC PAD APPARATUS, designed to protect the knee or elbow during athletic activity. A pad configured to cover the knee or elbow has velcro fasteners at each end which wrap around the leg or arm for attachment, unlike the present invention, requiring more effort and time to install.

In U.S. Pat. No. 6,204,714, issued to Leonard Katzin on Feb. 15, 2000, a DEFORMABLE ORTHOSIS is disclosed. Katzin's orthosis has a semi-rigid deformable spine running the length of a pad, and a plurality of velcro straps for attachment. By contrast, the present invention has a finger loop at a leading edge of a flexible pad, thereby speeding the donning of the pad.

A WRIST AND CARPAL PROTECTIVE GLOVE is disclosed in U.S. Pat. No. 5,404,591, issued to Alfred Brinnand, et al., on Apr. 11, 1995. Unlike the present invention, Brinnard provides protection only to the heal of the palm, leaving the leading edge of the palm unprotected.

U.S. Pat. No. 4,287,609, issued to James M. Amadeo on Sep. 8, 1981, discloses a PROTECTIVE HAND WRAP FOR ATHLETES. Unlike the present invention, which is easily attached to the hand by a finger loop and wrist strap, Amadeo must be repeatedly wrapped around the hand before fastening.

A WRIST BLOTTER is disclosed in U.S. Pat. No. 1,351,378, issued on Aug. 31, 1920, to Gustav Frankel. Frankel discloses a pad with a replaceable blotter which may be strapped around the wrist and forearm. Unlike the present invention, Frankel provides no protection to the palm.

None of the above inventions and patents, taken either singly or in combination, is seen to describe the instant invention as claimed.

SUMMARY OF THE INVENTION

During the games of baseball and softball, a runner frequently slides, hands extended, into a base or home plate in order to avoid a tag out by the player tending the base. With unprotected hands, the player sliding into the base may suffer jammed fingers, abrasions to the palm and/or wrist from sliding across the dirt surface of the base path, or hyper-extension of the wrist. Although a player may wear gloves to protect against abrasions from a slide, gloves are usually fairly tight fitting and often require some time to properly don. Therefore, it is desirable to have a protective device, which may be easily carried and donned, which will protect a base runner from abrasions, jams and/or hyper-extension during slides.

The present invention fulfills this need by providing a finger, palm and wrist protective pad which may be easily carried on the person during a game and easily donned while holding at a base, or even while running. The present invention consists of a leather pad shaped to fit the palm and wrist with a loop which may be easily slipped over the fingers and a wrist strap to hold the pad in place. A foam dowel at the leading edge provides protection to the fingers by providing a grasping element around which the fingers may be wrapped.

Accordingly, it is a principal object of the invention to provide a finger, palm and wrist protective pad which is inexpensive.

It is another object of the invention to provide a finger, palm and wrist protective pad which may easily be carried on a players person while running bases.

It is a further object of the invention to provide a finger, palm and wrist protective pad which may be easily donned during play.

Still another object of the invention is to provide a finger, palm and wrist protective pad which provides protection against abrasions during a slide into a base or home plate.

Yet another object of the invention is to provide a finger, palm and wrist protective pad which provides protection against finger jams during a slide into a base or home plate.

An additional object of the invention is to provide a finger, palm and wrist protective pad which provides protection again wrist hyper-extension and/or sprains during a slide into a base or home plate.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
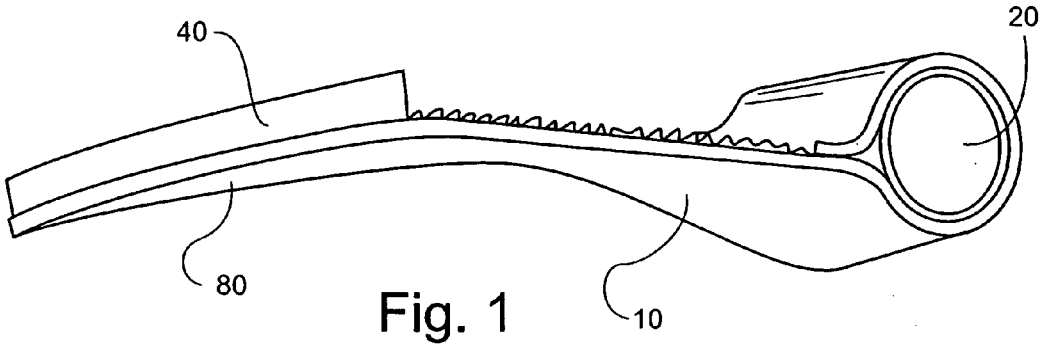
FIG. 1 is a side view of the present invention with the wrist strap removed.
Figure 2:
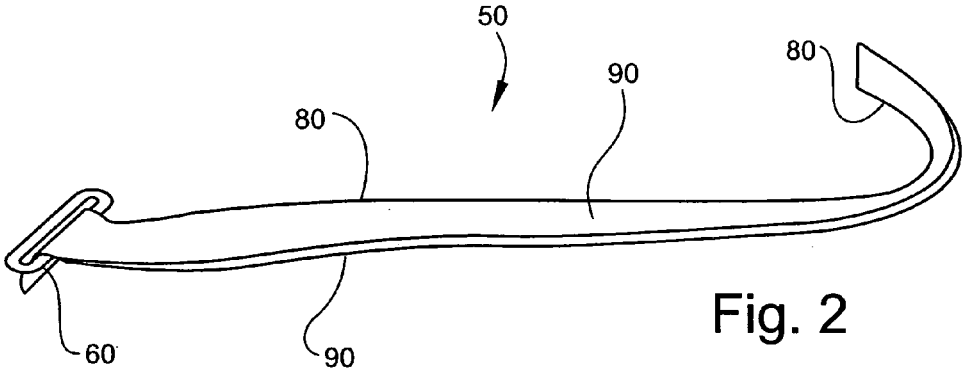
FIG. 2 is a side view of the wrist strap of the present invention.
Figure 3:
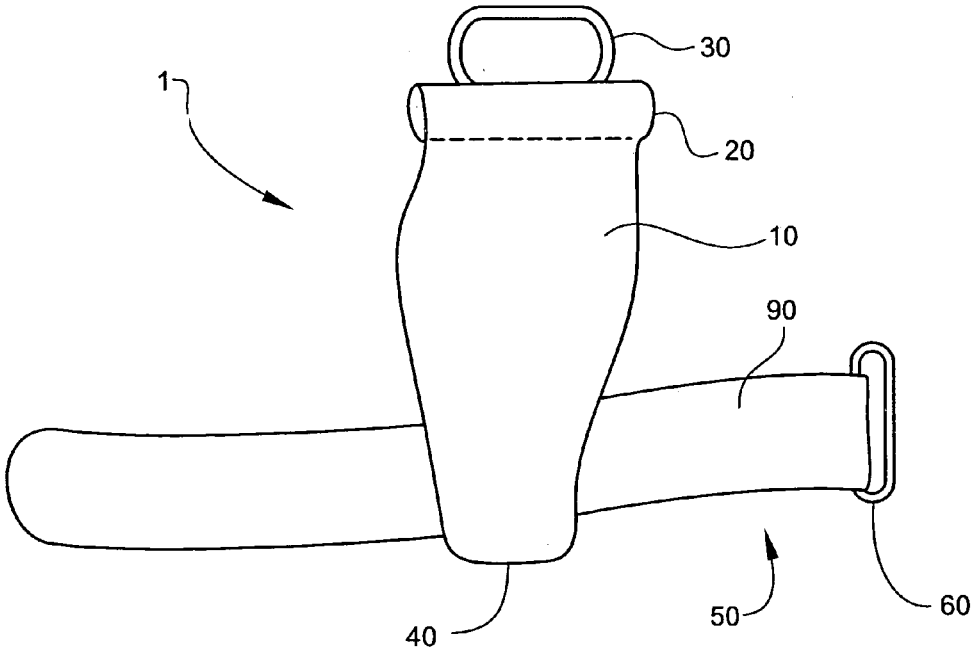
FIG. 3 is a top view of the present invention with the wrist strap open.
Figure 4:
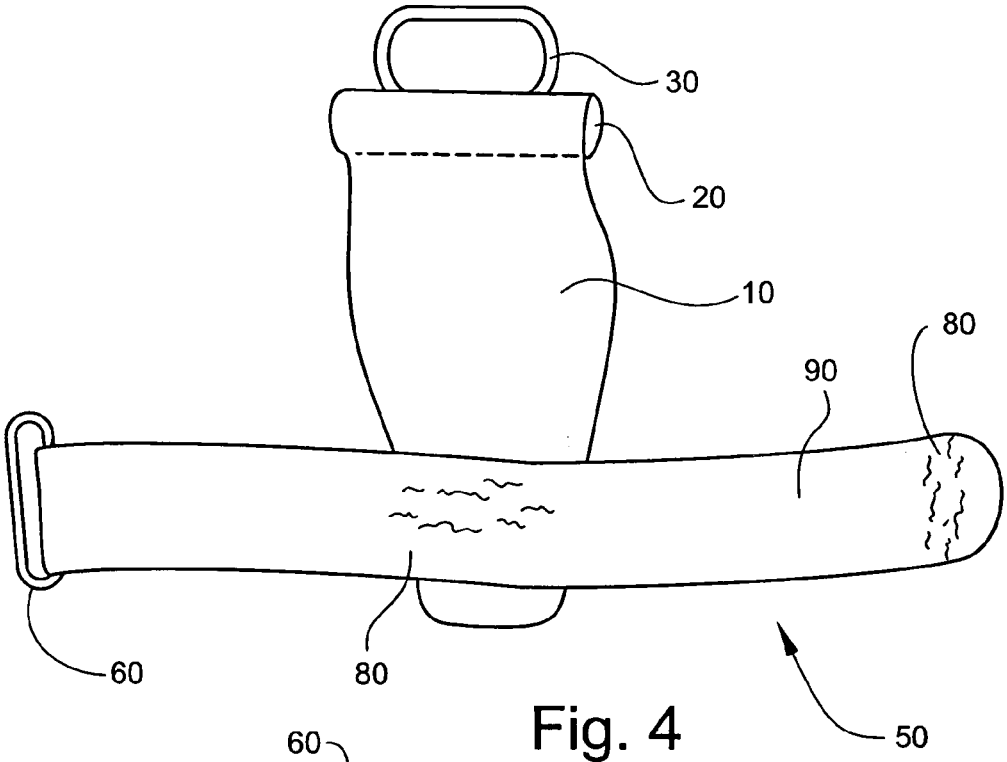
FIG. 4 is a bottom view of the present invention with the wrist strap open.
Figure 5:
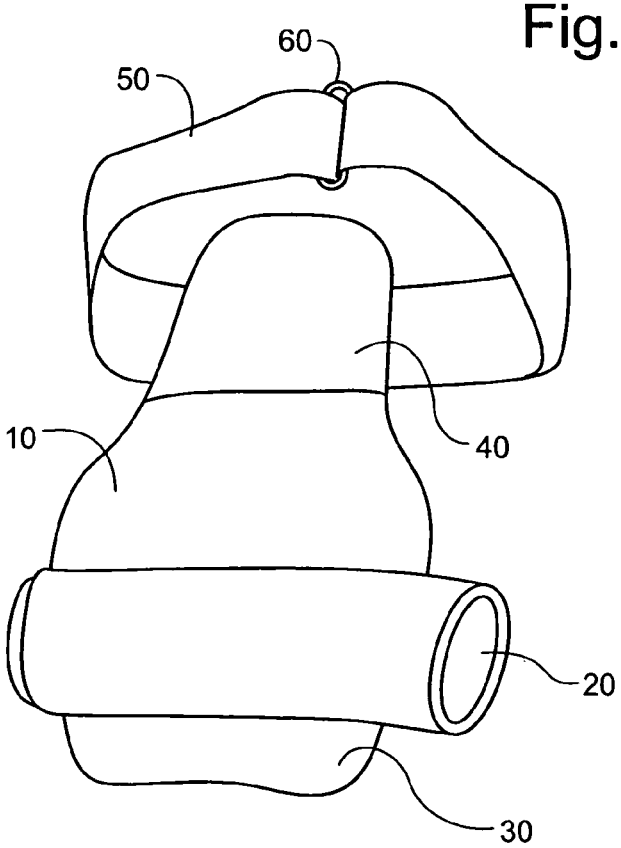
FIG. 5 is an environmental perspective side view of the present invention with the wrist strap buckled.
Figure 6:
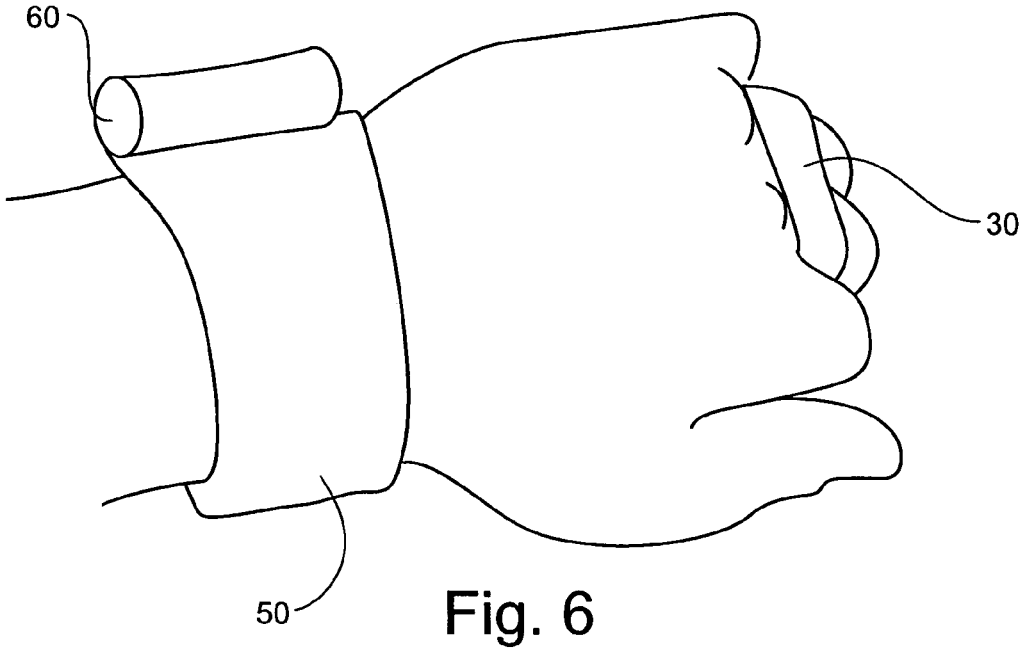
FIG. 6 is an environmental perspective view of the back of a hand with the present invention installed.
Figure 7:
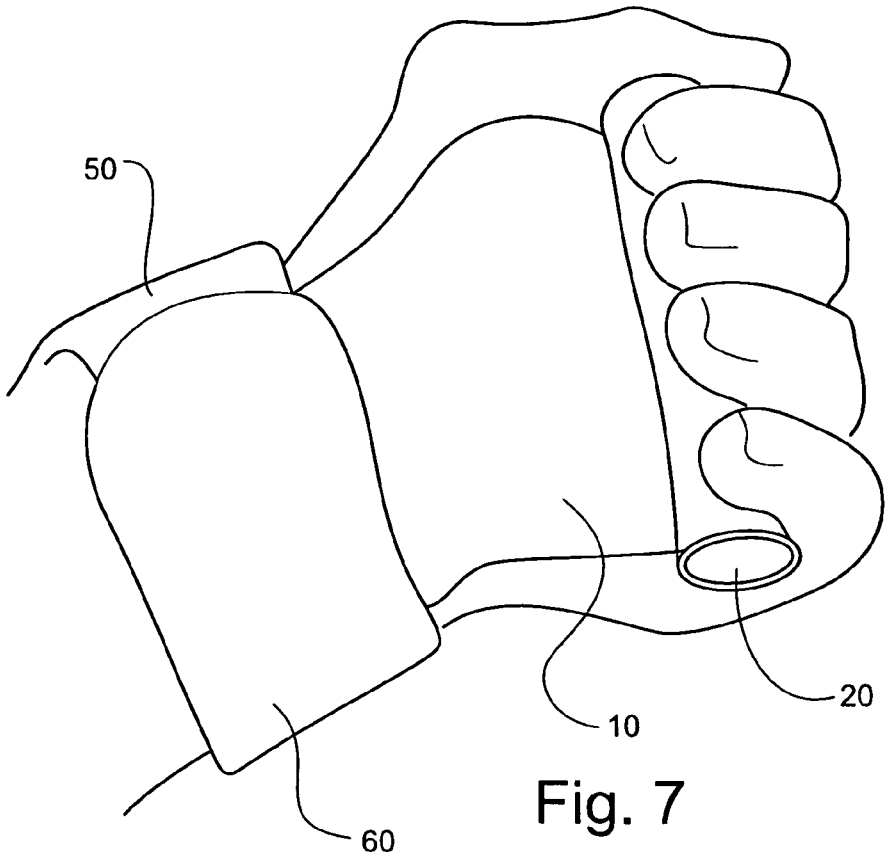
FIG. 7 is an environmental perspective view of the palm and wrist of a hand with the present invention installed.

As illustrated at FIGS. 1 thru 7, the primary element of the finger, palm and wrist protective pad 1 of the present invention is a pad 10, having a first, finished side, and a second, textured side, cut to substantially coincide with the shape and size of a human palm and wrist.

At a first, digit end 12 of pad 10, pad 10 is looped around a foam dowel 20 such that the digit end 12 of pad 10 is stitched to pad 10, forming a sleeve 14 enclosing foam dowel 20 along its length. An elastic loop 30 is stitched to the outer surface of the sleeve 14 at a point substantially opposite the point at which the digit end 12 of pad 10 is stitched to pad 10. Pad 10 is looped around foam dowel 20 such that digit end 12 of pad 10 is stitched to pad 10 on the textured side, thereby leaving the finished side exposed. Loop 30 is adapted to receive at least one finger of a hand on which the palm and wrist protective pad 1 is installed, with the textured side of pad 10 against the palm of the hand. Foam dowel 20 is adapted to form a rounded and padded leading edge of pad 10, which may be grasped by the fingers to prevent jamming. For durability pad 10 is preferably of a rugged leather.

At a second, wrist end of pad 10, a foam pad 40 is attached to the textured side of leather pad 10 to provide added protection to the wrist area, while hook fastener 80 is attached to the finished side of pad 10. Both foam pad 40 and hook fastener 80 are typically attached by glueing and/or stitching.

A wrist strap 50, again, preferably leather, is attached, transverse to the length of pad 10 by attachment to the hook fastener 80 cited above, as will be further detailed hereinafter. A buckle 60 is attached at a first end of wrist strap 50, buckle 60, being a slot through which a second, free end of wrist strap 50 may pass. Loop fastener 90 lines the interior surface of wrist strap 50 from a point proximate buckle 60, extending along approximately two thirds of the length of wrist strap 50. The lining of loop fastener 90 provides protection against chafing of the wrist by the leather of wrist strap, while also removably attaching wrist strap 50 to the hook 80 fastener attached to the finished side of pad 10, above. Hook 80 and loop 90 fastenings are applied to the exterior surface of wrist strap 50, preferably with the loop 90 portion attached in the region from the free end of wrist strap 50 to a proximate midpoint of the length of wrist strap 50 and the hook 90 portion attached from the proximate midpoint to a proximate three quarter point of the length of wrist strap 50. Wrist strap 50 is secured by pulling the free end of wrist strap 50 through buckle 60 and pulling wrist strap 50 back against itself such that the hook 80 and loop 90 engage to hold wrist strap 50 in a closed state. It would be evident to one skilled in the art that while a leather wrist strap 50 is preferred, wrist strap 50 could be of a variety of materials known to the art. It would be further evident to one skilled in the art that buckle 60 could be formed of a metal, a plastic, or even as a reinforced slot cut in the leather of wrist strap 50, or by other means known to the art.

While wrist strap 50 could be permanently attached to leather pad 10 by glueing and/or stitching, it is preferable that wrist strap 50 be removably attached to leather pad 10, as cited above, allowing adjustment of the distance between foam dowel 20 and wrist strap 50, thereby compensating for differing palm lengths.

While the primary function of foam dowel 20 is to provide a cushioned grip around which the fingers may wrap to protect against jamming, it further serves to prevent debris from entering under leather pad 10 to cause abrasions. Leather pad 10 provides protection against abrasion to the palm and wrist and hyper-extension of the wrist, while foam pad 40 provides added protection to the wrist against bruising, abrasions and contusions.

It is to be understood that the present invention is not limited to the embodiments described above, but encompasses any and all embodiments within the scope of the following claims.

What is claimed is:

1. An athletic finger, palm and wrist protective pad, comprising:

digit protective means for protecting the fingers of a user from jamming, said digit protective means sized and positioned such that, when installed on a hand, all four fingers of the hand can curl around and grasp the digit protective means, palm and wrist protective means for protecting substantially the entire palmar surface of the palm and wrist of a user from abrasion and hyper-extension, digit engagement means for attaching said finger, palm and wrist protective pad to the fingers of a user's hand, wrist engagement menas for attaching said finger, palm and write protective pad to the wrist of a user, and first securing means for securing said wrist engagement means to said palm and wrist protective means, and second securing means for securing said wrist engagement means in a closed state, said palm and wrist protective means comprising a pad having a first side for facing away from the palm of a wearer and a second side for facing toward the palm of a wearer, a digit end and a wrist end, said pad formed to substantially conform to the shape of a human palm and wrist, and said digit protective means comprises a dowel, said dowel being enclosed in a sleeve formed in said digit end of said leather pad, said sleeve being formed by said pad being rolled such that said first side is exterior said roll and said digit end is attached to said pad along a line proximate said digit end of said pad.

2. An athletic finger, palm and wrist protective pad, as defined in claim 1, wherein said pad is formed of leather.

3. An athletic finger, palm and wrist protective pad, as defined in claim 2, wherein said dowel further comprises a foam dowel.

4. An athletic finger, palm and wrist protective pad, as defined in claim 1 wherein said digit end of said pad is permanently attached to a portion of said first side of said pad, thereby forming said sleeve.

5. An athletic finger, palm and wrist protective pad, as defined in claim 1, wherein said palm and wrist protective means further comprises a foam pad attached to said second side of said pad proximate said wrist end of said pad.

6. An athletic finger, palm and wrist protective pad, as defined in claim 5, wherein said foam pad is permanently attached to said pad.

7. An athletic finger, palm and wrist protective pad, as defined in claim 5, wherein said digit engagement means comprises a loop of material attached to said sleeve at a point on said sleeve substantially opposite said line of attachment of said digit end of said pad to said first side of said pad, said loop adapted to slide over at least one finger of a user's hand to surround said at least one finger near to where said at least one finger joins the palm of the user's hand.

8. A athletic finger, palm and wrist protective pad, as defined in claim 7, wherein said loop is of an elastic material, thereby facilitating easy entrance of the fingers of a user's hand entering said loop.

9. An athletic finger, palm and wrist protective pad, as defined in claim 7, wherein said wrist engagement means comprises a strap, said strap attached to said first side of said pad by said first securing means, transverse said pad, proximate said wrist end of said pad, said strap having a first side and a second side, a first end and a second end, said first securing means comprising means for enabling said strap to be removably attached to said pad at any of a plurality of distances from said dowel, thereby allowing adjustability of said finger, palm and wrist protective pad to be sized to fit a particular palm length of a user.

10. An athletic finger, palm and wrist protective pad, as defined in claim 9, wherein said strap is formed of leather.

11. An athletic finger, palm and wrist protective pad, as defined in claim 9, wherein said first securing means comprises hook and loop fastener, a first of said hook and loop fastener elements being affixed to said first side of said leather pad and a second of said hook and loop fastener elements being affixed to the second side of said wrist strap.

12. An athletic finger, palm and wrist protective pad, as defined in claim 9, wherein said second securing means comprises a buckle attached at said first end of said strap.

13. An athletic finger, palm and wrist protective pad, as defined in claim 12, wherein said buckle is formed of at least one material selected from the group consisting of metal and plastic.

14. An athletic finger, palm and wrist protective pad, as defined in claim 13, wherein said second securing means further comprises hook and loop fastener attached to said first side of said strap, said hook fastener attached proximate one of said ends of said strap and said loop fastener attached proximate the other of said ends of said strap, such that, after passing through said buckle, said strap is secured by attaching said loop fastener to said hook fastener.

15. An athletic finger, palm and wrist protective pad comprising:

a pad having a first side for facing away from the palm of a wearer and a second side for facing toward the palm of a wearer, a digit end and a wrist end, said pad formed to substantially conform to the shape of a human palm and wrist and sized and shaped to cover substantially the entire palmar surface of a wearer's palm and wrist, said digit end of said pad being rolled such that said first side is exterior said roll and said digit end is permanently attached to a portion of said first side of said pad along a line proximate said digit end of said pad, thereby forming a sleeve, and a dowel, said dowel housed within said sleeve formed in said pad, said dowel and said sleeve forming a rounded forward edge of said leather pad, said dowel and sleeve sized and positioned such that, when installed on a hand, all four fingers of the hand can curl around and grasp the sleeve enclosed dowel, and a foam pad attached to said second side of said pad proximate said wrist end of said pad;

a loop of elastic material attached to said sleeve at a point on said sleeve opposite said line of attachment of said digit end of said pad to said first side of said pad, said loop adapted to slide over at least one finger of a user's hand; and a wrist strap, said wrist strap attached to said first side of said pad, transverse said pad, proximate said wrist end of said pad, said strap having a first side and a second side, a first end and a second end, said wrist strap being removably attached to said pad at any of a variety of distances from said dowel by hook and loop fastener, a buckle attached at said first end of said strap, and hook and loop fastener attached to said first side of said strap, said hook fastener attached proximate one of said ends of said strap and said loop fastener attached proximate the other of said ends of said strap, such that, after passing through said buckle, said strap is secured by attaching said loop fastener to said hook fastener;

wherein, when said athletic finger, palm and wrist protective pad is in use:

said pad provides protection against abrasion to a user's hands from contact with the ground and hyper-extension of the wrist during a slide with hands extended, said dowel and said sleeve provide additional padding and a rounded edge graspable by the fingers of a player, thereby preventing jamming of the fingers, abrasions and bruising and the entry of debris under a leading edge of said pad during a slide, said elastic loop secures said pad around the fingers of a user's hand, said wrist strap secures said pad around the wrist of a user, and said removable attachment of said wrist strap to said pad provides adjustment of a distance between said dowel and said wrist strap, thereby allowing compensation for differing palm lengths of different users.

* * * * *